US010989024B2

(12) United States Patent
Fripp et al.

(10) Patent No.: US 10,989,024 B2
(45) Date of Patent: Apr. 27, 2021

(54) METHOD AND SYSTEM FOR COMMUNICATION BY CONTROLLING THE FLOWRATE OF A FLUID

(71) Applicant: Halliburton Energy Services, Inc., Houston, TX (US)

(72) Inventors: Michael Linley Fripp, Carrollton, TX (US); Zahed Kabir, Garland, TX (US); Donald Kyle, Plano, TX (US); Richard Decena Ornelaz, Frisco, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 0 days.

(21) Appl. No.: 16/061,955

(22) PCT Filed: Dec. 28, 2016

(86) PCT No.: PCT/US2016/068868
§ 371 (c)(1),
(2) Date: Jun. 13, 2018

(87) PCT Pub. No.: WO2018/125078
PCT Pub. Date: Jul. 5, 2018

(65) Prior Publication Data
US 2019/0136674 A1 May 9, 2019

(51) Int. Cl.
*E21B 43/12* (2006.01)
*E21B 47/18* (2012.01)
*E21B 47/06* (2012.01)

(52) U.S. Cl.
CPC ..... *E21B 43/12* (2013.01); *E21B 47/18* (2013.01); *E21B 47/06* (2013.01)

(58) Field of Classification Search
CPC ..... E21B 43/12; E21B 47/18; E21B 47/06
See application file for complete search history.

(56) References Cited

U.S. PATENT DOCUMENTS 4,351,037 A 9/1982 Scherbatskoy
5,113,379 A * 5/1992 Scherbatskoy ..... E21B 41/0085 367/83

(Continued)

FOREIGN PATENT DOCUMENTS

WO 2016030412 A1 3/2016

OTHER PUBLICATIONS

International Search Report and the Written Opinion for International Application No. PCT/US2016/068868 dated Sep. 11, 2017, 17 pages.

*Primary Examiner* — Amine Benlagsir
(74) *Attorney, Agent, or Firm* — Chamberlain Hrdlicka

(57) ABSTRACT

A method and system of communicating with a device by controlling the flow rate of a fluid. The method comprises transmitting an encoded message with a flow control device by controlling the flow rate of a fluid and generating a signal indicative of the flow rate with a receiver. The method also comprises decoding the message by analyzing the signal using amplitude shift-keying. The system comprises a flow control device, a receiver, and a controller. The flow control device is in fluid communication with a tubular string and transmits an encoded message by controlling the flow rate of the fluid flowing through the tubular string. The receiver generates a signal indicative of the flow rate of the fluid in the tubular string. The controller is in communication with the receiver and decodes the message by analyzing the signal using amplitude shift-keying.

23 Claims, 8 Drawing Sheets

(56) References Cited

U.S. PATENT DOCUMENTS

| | | | | |
|---|---|---|---|---|
| 6,384,738 | B1 | 5/2002 | Carstensen et al. | |
| 6,464,011 | B2 | 10/2002 | Tubel | |
| 6,554,074 | B2 | 4/2003 | Longbottom | |
| 6,710,720 | B2 | 3/2004 | Carstensen et al. | |
| 6,874,361 | B1 | 4/2005 | Meltz et al. | |
| 2006/0022839 | A1 | 2/2006 | Hall et al. | |
| 2006/0225920 | A1 | 10/2006 | Treviranus et al. | |
| 2008/0053240 | A1* | 3/2008 | Henry | G01F 15/024 73/861.04 |
| 2010/0084192 | A1 | 4/2010 | Jeffryes | |
| 2011/0079386 | A1 | 4/2011 | Fripp et al. | |
| 2011/0286309 | A1* | 11/2011 | Sugiura | E21B 47/18 367/83 |
| 2013/0021166 | A1 | 1/2013 | Shah et al. | |
| 2013/0162440 | A1 | 6/2013 | Parry et al. | |
| 2014/0299330 | A1 | 10/2014 | Fripp et al. | |
| 2014/0338922 | A1 | 11/2014 | Lopez et al. | |
| 2014/0368350 | A1* | 12/2014 | Wang | G01V 3/00 340/854.4 |
| 2015/0034385 | A1 | 2/2015 | Kolbe et al. | |
| 2015/0152727 | A1 | 6/2015 | Fripp et al. | |
| 2015/0275660 | A1 | 10/2015 | Logan et al. | |
| 2015/0378363 | A1* | 12/2015 | Lerner | G05B 15/02 700/282 |
| 2016/0017660 | A1 | 1/2016 | Golla et al. | |
| 2016/0090800 | A1 | 3/2016 | Jeffryes | |
| 2016/0168984 | A1 | 6/2016 | Fripp et al. | |

* cited by examiner

METHOD AND SYSTEM FOR COMMUNICATION BY CONTROLLING THE FLOWRATE OF A FLUID

This section is intended to provide relevant contextual information to facilitate a better understanding of the various aspects of the described embodiments. Accordingly, it should be understood that these statements are to be read in this light and not as admissions of prior art.

After a wellbore has been formed various downhole tools may be inserted into the wellbore to extract the natural resources such as hydrocarbons or water from the wellbore, to inject fluids into the wellbore, and/or to maintain the wellbore. At various times during production, injection, and/or maintenance operations, it may be necessary to communicate with devices located in the wellbore, such as screens, flow control devices, slotted tubing, packers, valves, sensors, actuators, or other downhole tools.

DESCRIPTION OF THE DRAWINGS

Embodiments of the invention are described with reference to the following figures. The same numbers are used throughout the figures to reference like features and components. The features depicted in the figures are not necessarily shown to scale. Certain features of the embodiments may be shown exaggerated in scale or in somewhat schematic form, and some details of elements may not be shown in the interest of clarity and conciseness.

DETAILED DESCRIPTION

Figure 1A:
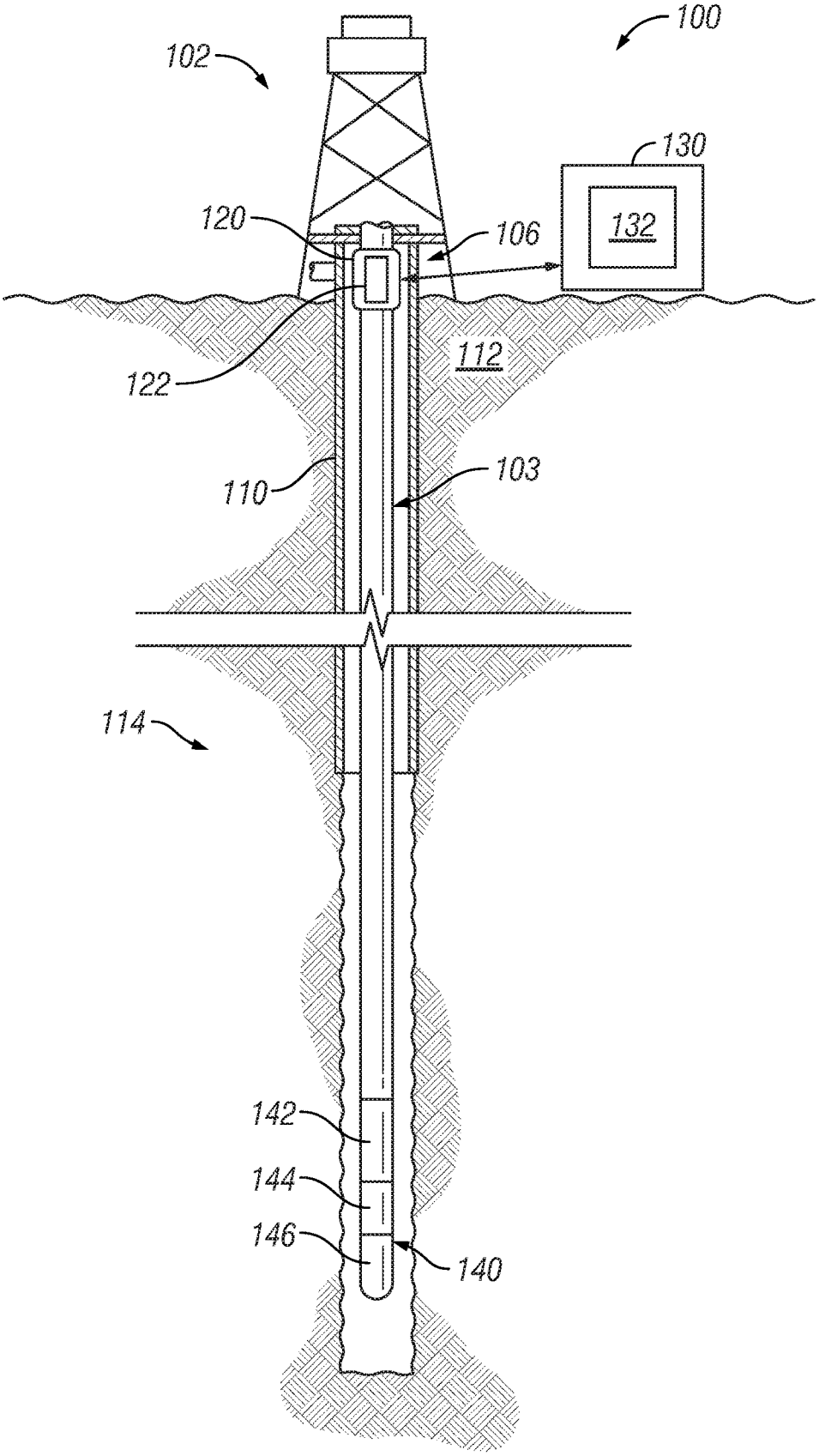
FIG. 1A shows an elevation view of a well system, in accordance with one or more embodiments, according to one or more embodiments.

FIG. 1 shows an elevation view of a well system 100, in accordance with one or more embodiments. The well system

100 may include a well site 106 with various types of equipment such as a rotary table, drilling fluid or production fluid pumps, drilling fluid tanks (not expressly shown), and other drilling or production equipment located at the well site 106. For example, the well site 106 may include a drilling rig 102 that may have various characteristics and features associated with a land drilling rig. However, it should be appreciated that downhole drilling tools incorporating embodiments of the present disclosure may be used with drilling equipment located on offshore platforms, drill ships, semi-submersibles and drilling barges (not expressly shown).

The well system 100 may also include a tubular string 103, which may be used to produce hydrocarbons such as oil and gas and other natural resources such as water from a subterranean earth formation 112 via a wellbore 114. The tubular string 103 may also be used to inject a stimulation fluid, such as brine, water, drilling fluid, oil, acid (organic or inorganic), a gel, or a combination thereof, into the formation 112 via the wellbore 114. The tubular string 103 may include, but is not limited to, a fluid conveyance device, rigid carriers, non-rigid carriers, coiled tubing, casing, liners, drill pipe, production tubing, completion tubing, etc. Although not illustrated in FIG. 1, portions of the wellbore 114 may be substantially horizontal (e.g., substantially parallel to the surface), or at an angle between vertical and horizontal. A casing string 110 is shown placed in the wellbore 114 and held in place by cement injected between the casing string 110 and the sidewalls of the wellbore 114. The casing string 110 provides radial support to the wellbore 114 and may seal against unwanted communication of fluids between the wellbore 114 and the surrounding formation 112. The casing string 110 may extend from the well site 106 to a selected downhole location within the wellbore 114. Portions of the wellbore 114 that do not include casing string 110 may be referred to as open hole.

The well system 100 may also include a flow control device 120, a surface controller 130, and a downhole assembly 140. The flow control device 120 may be used to transmit an encoded message to the downhole assembly 120 by controlling the flow rate of a fluid flowing through the tubular string 103. As used herein, a "message" may refer to one or more symbols encoded by controlling the flow rate of the fluid. The flow control device 120 and the downhole assembly 140 may be in fluid communication with the tubular string 103. The flow control device 120 may be communicatively coupled to the surface controller 130 via either a wired or wireless connection to allow the surface controller 130 to wirelessly communication with the downhole assembly 140. The flow control device 120 may include a valve operable to vary the flow rate of fluid flowing through the tubular string 103. The flow control device 120 may further include a sensor 122 (e.g., a flow meter or pressure gauge) to provide closed-loop feedback of the flow rate to the controller for encoding a message by controlling the flow rate of the fluid.

The surface controller 130 includes a computer system 132 for processing and controlling the flow control device 120 to transmit a message to the downhole assembly 140. Among other things, the computer system 132 may include a processor and a non-transitory machine-readable medium (e.g., ROM, EPROM, EEPROM, flash memory, RAM, a hard drive, a solid state disk, an optical disk, or a combination thereof) capable of executing instructions to perform such tasks. The surface controller 130 may further include a user interface (not shown), e.g., a monitor or printer, to display messages or commands available to be transmitted to the downhole assembly, as further described herein. The computer system 132 may also be capable of controlling the downhole assembly 140 via the transmitted messages.

As shown, the downhole assembly 140 is coupled to the tubular string 103 and includes a receiver 142, a controller 144, and a downhole tool 146. The downhole assembly 140 may be used to perform operations relating to completion of the wellbore 114, production of hydrocarbons and other natural resources from the formation 112 via the wellbore 114, injection of stimulation fluids into the formation 112 via the wellbore 114, and/or maintenance of the wellbore 114. The downhole tool 140 may include a wide variety of components configured to perform these or other operations. For example, the downhole tool 146 may include, but is not limited to, a screen, flow control device, slotted tubing, packer, valve, sensor, and actuator. The sensor of the downhole tool 146 may include a device responsive to electromagnetic radiation for measuring formation resistivity, a gamma ray device for measuring formation gamma ray intensity, devices for measuring the inclination and azimuth of the tubular string 103, pressure sensors for measuring fluid pressure, temperature sensors for measuring wellbore temperature, distributed optical sensors, a flow meter for measuring flow rates, geophones or accelerometers for taking seismic, microseismic, or vibration measurements, a device for measuring fluid composition, etc.

The downhole tool 146 may include a screen to filter sediment from fluids flowing between the wellbore 114 and downhole assembly 140. The downhole tool 146 may also include a flow control device to regulate the flow of fluids between the wellbore 114 and the tubular string 103. The flow resistance provided by the flow control device may be adjustable in order to increase or decrease the rate of fluid flow through the flow control device or to communicate with the surface controller 130 as further described herein.

As an example operation, fluids may be extracted from or injected into the wellbore 114 via the downhole assembly 140 and the tubular string 103. For example, production fluids, including hydrocarbons, water, sediment, and other materials or substances found in the formation 112 may flow from the formation 112 into wellbore 114 through the sidewalls of open hole portions of the wellbore 114. The production fluids may circulate in the wellbore 114 before being extracted from the wellbore 114 via the downhole assembly 140 and the tubular string 103.

As another example operation, fluids may also be injected into the wellbore 114 via the tubular string 103 and the downhole assembly 140. A stimulation operation may be performed including, but not limited to, formation cleanup, acidization, gravel packing, and/or hydraulic fracturing of the wellbore. Thus, it should be appreciated that the communication scheme described herein may be independent of the direction of fluid flowing through the tubular string 103.

The receiver 142 is used to generate a signal indicative of the flow rate of the fluid controlled by the flow control device 120, such as the fluid flowing through, into, or exiting the tubular string 103, to decode the message in the flow rate. The receiver 142 may include a flow meter, a turbine generator, an acoustic sensor, a vibration sensor, or any other suitable device to measure the flow rate of a fluid. The receiver 142 may be in fluid communication with the fluid in the tubular string 103 to produce a signal indicative of the flow rate. For example, the receiver 142 may be a turbine generator located on the downhole assembly 140 and operable to supply electrical power to the various components of the downhole assembly 140. The turbine generator may produce an electrical signal indicative of the flow rate of the fluid in the tubular string 103. However, it should be appreciated that the receiver may measure the flow rate of the fluid entering, flowing through, or exiting the tubular string 103. The flow rate may also be determined with an acoustic sensor (e.g., a piezoelectric transducer) or a vibration sensor (e.g. an accelerometer) by recording the vortex shedding frequency or the turbulent noise generated from the flow of fluid through the tubular string 103. The output of the receiver 142 (e.g., a sinusoidal signal from a turbine generator, samples recorded by a flowmeter, or the vortex shedding frequency or the turbulent noise recorded by an acoustic sensor or vibration sensor) may be converted to the signal indicative of the flow rate of the fluid.

The controller 144 is used to decode the encoded message transmitted by the flow control device 120 and execute instructions based on the message. The controller 144 is operable to decode the message by analyzing the signal using amplitude shift-keying. Upon decoding the message, the controller 144 may operate the downhole tool 146, including but not limited to setting or releasing a latch, releasing a baffle, shifting a sleeve, setting a packer, taking a sensor reading, and opening or closing a valve to perform various operations in the wellbore 114. Based on the decoded message, the controller 144 may also update the software that controls or operates the downhole tool 146. However, it should be appreciated that the message may provide the controller 144 with a variety of instructions, commands, or data. The controller 144 may include a processor and a non-transitory machine-readable medium (e.g., ROM, EPROM, EEPROM, flash memory, RAM, a hard drive, a solid state disk, an optical disk, or a combination thereof) designed to and capable of executing instructions to perform such tasks.

Although FIG. 1 has been described as providing a communication system that allows the surface controller 130 to communicate with the downhole assembly 140, it should be appreciated that the communication system may be employed for bidirectional communication between the downhole assembly 140 and surface controller 130. For example, the downhole tool 146 and controller 144 may be operable to transmit a message by controlling the flow rate of the fluid flowing through the tubular string 103. The sensor 122 may serve as the receiver for a message transmitted from the downhole tool 146 to the surface. The surface controller 130 may decode the message by analyzing the signal indicative of the flow rate measured by the sensor 122. The message transmitted from the downhole tool 146 may include data relating to wellbore conditions, such as temperature, pressure, flow rate, fluid composition, measured by one or more sensors deployed downhole.

The communication scheme described herein may also be employed to communicate among devices located along the tubular string 103. It should also be appreciated that the communication scheme described herein may be employed to communicate among devices located at the surface positioned along a fluid conveyance device, such as a tubular string or pipeline.

Figure 1B:
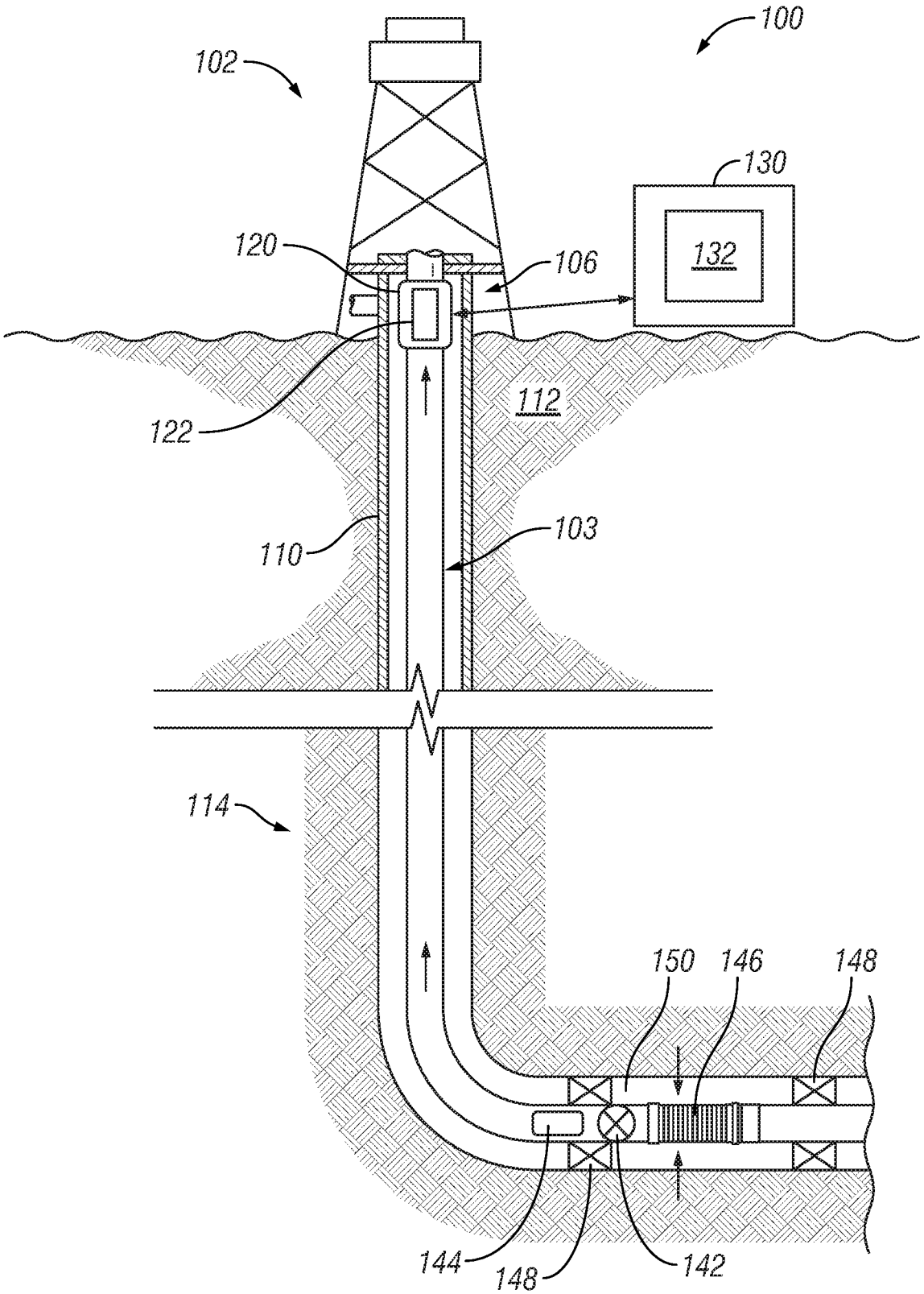
FIG. 1B shows an elevation view of another well system, in accordance with one or more embodiments.

FIG. 1B shows an elevation view of the well system 100 employed in a production operation, according to one or more embodiments. As shown, the downhole tool 146 is an inflow control device ("ICD") used to regulate the fluid influx from the formation 112 into the tubular string 103. As a non-limiting example, the downhole tool 146 may be the EquiFlow® ICD available from Halliburton Energy Services, Inc., of Houston, Tex. The downhole tool 146 is positioned between a pair of annular barriers depicted as packers 1148 that provide a fluid seal between the tubular string 103 and the wellbore 114, thereby defining a production interval 150. The receiver 142 generates a signal indicative of the flow rate of the fluid controlled by the flow control device 120, such as the fluid flowing through the tubular string 103. As shown, the receiver 142 is a turbine generator or a flow meter in fluid communication with the tubular string 103. The controller 144 decodes the message by analyzing the signal as further described herein. The message may be a command to control the operation of the downhole tool 146, such as setting a flow rate output of a valve in fluid communication with the ICD.

Figure 2:
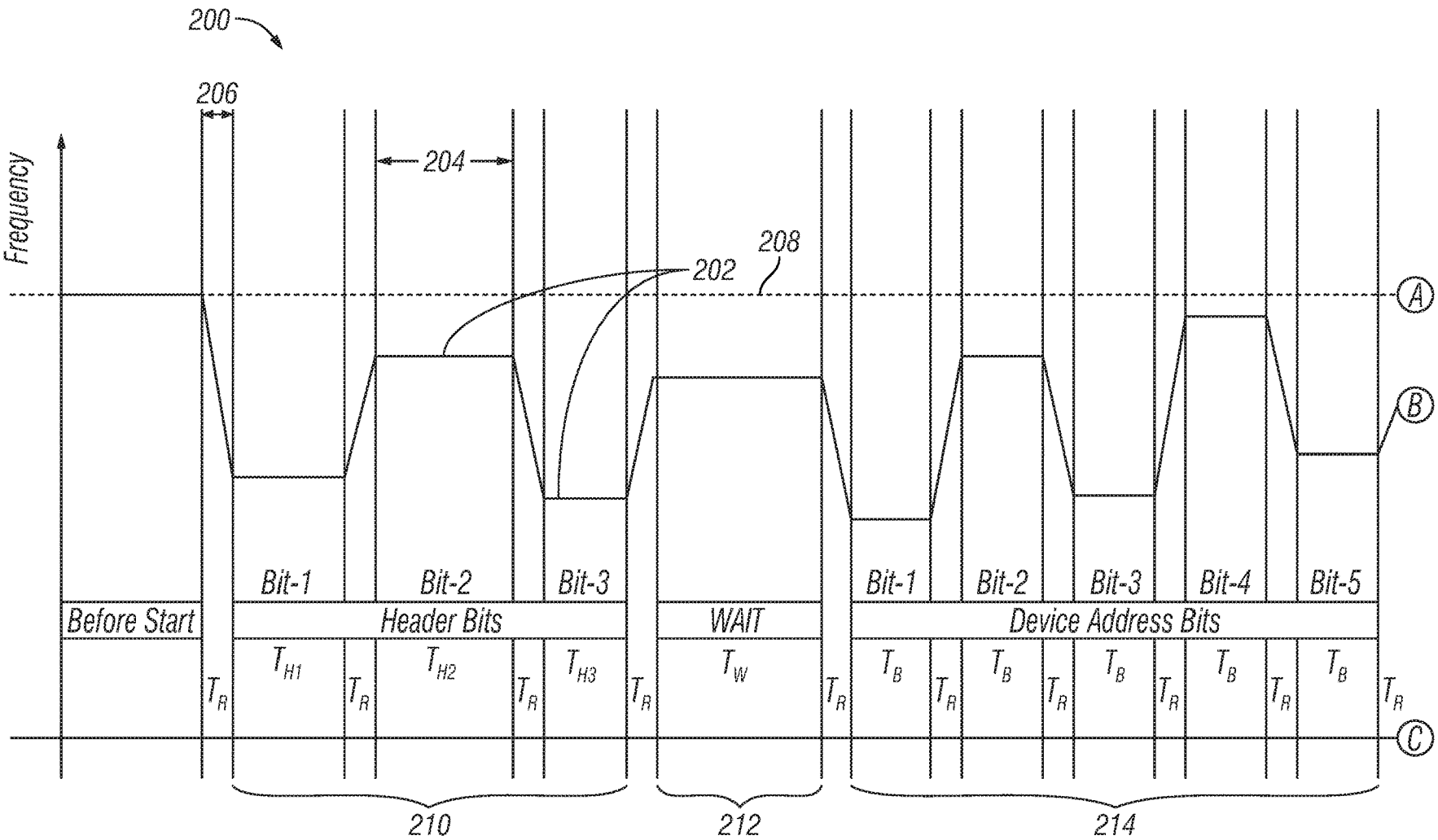
FIG. 2 shows a graph view of a message encoded by varying the flow rate of a fluid, according to one or more embodiments.
Figure 2:
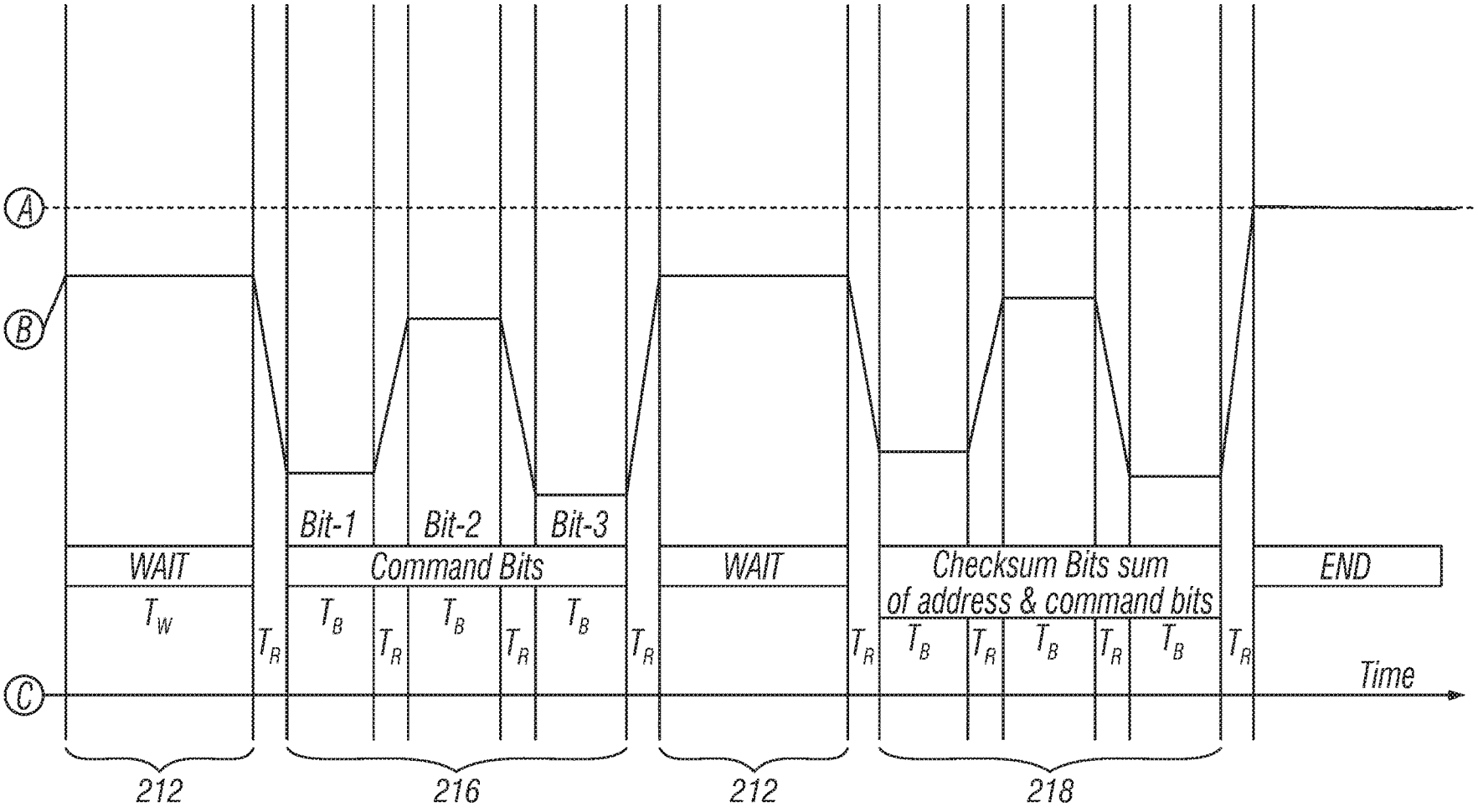

FIG. 2 shows a graph view of a message 200 encoded by varying the flow rate of a fluid, in accordance with one or more embodiments. As shown, the message 200 is a function of flow rate (e.g., gallons per minute) with respect to time (e.g., seconds). The message 200 comprises symbols 202 that may be encoded using a wide variety of modulation schemes that vary the flow rate of the fluid. For example, the symbol 202 may be encoded by varying the flow rate if the previous symbol differs from the current symbol or maintaining the same flow rate for consecutive symbols that have the same value. As used herein, a symbol refers to the state of a signal at a specific time, the signal having a specific phase, amplitude, and frequency. Each symbol may be transmitted for a specific length of time referred to as a symbol period 204, and the symbols 202 may be separated by a guard time 206 to allow for a change in flow rate between symbols. The message 200 may include a variety of symbols with a suitable symbol period (e.g., $T_{H1}$, $T_{H2}$, $T_{H3}$, $T_W$, or $T_B$). The symbol periods may not be the same for all of the symbols 202 and each symbol 202 may have a different symbol period in the message 200. The message 200 may also be encoded by controlling the length of the symbol periods using pulse-width modulation. The dashed line 208 represents the maximum flow rate of the fluid that can flow through a fluid conveyance device, such as the tubular string 103 of FIG. 1. For example, the maximum flow rate may occur when the fluid is not obstructed by the flow control device 120 of FIG. 1. The message 200 is encoded by controlling the amplitude of the symbols 202 and the symbols 202 may be compared with one or more threshold(s) to identify the value of the symbols 202 as further described herein.

As shown, the message 200 comprises fourteen symbols 202 comprising a 3-bit header 210, wait states 212, a 5-bit device address 214, a 3-bit command 216, and a 3-bit checksum 218. However, it should be appreciated that any number of symbols may be included in the message and other suitable message structures may be implemented to encode a message. As non-limiting examples, the checksum may be replaced with error correction; the wait states may be shortened, lengthened, or eliminated; or a series of synchronization symbols may be included in the message. As previously mentioned, different symbol periods may be used in the message 200. In the example shown in FIG. 2, multiple different symbol periods $T_{H1}$, $T_{H2}$, and $T_{H3}$ are used in the header 210 and the symbol periods $T_{H1}$, $T_{H2}$, and $T_{H3}$ for the header 210 have different lengths than the rest of the symbol periods ($T_W$ and $T_B$) in the message 210. The different symbol periods may convey additional information in the message using pulse-width modulation.

Figure 3:
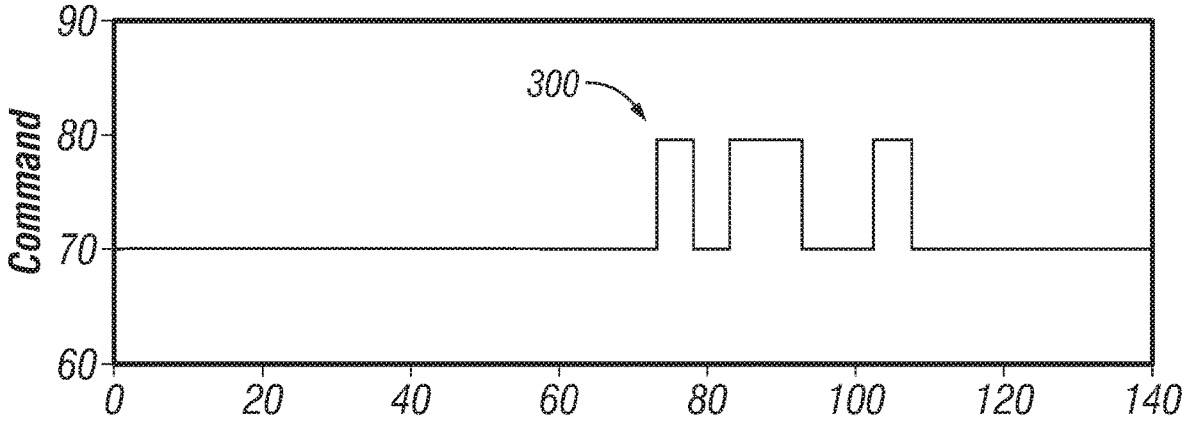
FIG. 3 shows a graph view of another message encoded by varying the flow rate of a fluid with a flow control device, in accordance with one or more embodiments.

FIG. 3 shows a graph view of a message 300 encoded by controlling the flow rate of a fluid with a flow control device, in accordance with one or more embodiments. As shown, the message 300 is a function of flow rate (e.g., gallons per minute) with respect to time (e.g., seconds). As a non-limiting example, the modulation scheme to encode the message 300 uses a binary amplitude-shift keying scheme based on the flow rate of the fluid, and thus, each symbol has either two states: 0-bit state or a 1-bit state. In this example, a flow rate of 70 gal/min (265 L/min) and 80 gal/min (303 L/min) are used to encode a 0-bit state and 1-bit state, respectively, with a threshold of 5 gal/min (19 L/min) difference to distinguish between the symbol states. Each symbol is also transmitted for a 5 second symbol period. The binary values encoded in the message 300 are "101100100" starting from the first rising edge on the left. It should be appreciated that the modulation scheme may use more than two flow rate states to encode the message, such as trinary, quadrature, or M-ary amplitude encoding.

Figure 4:
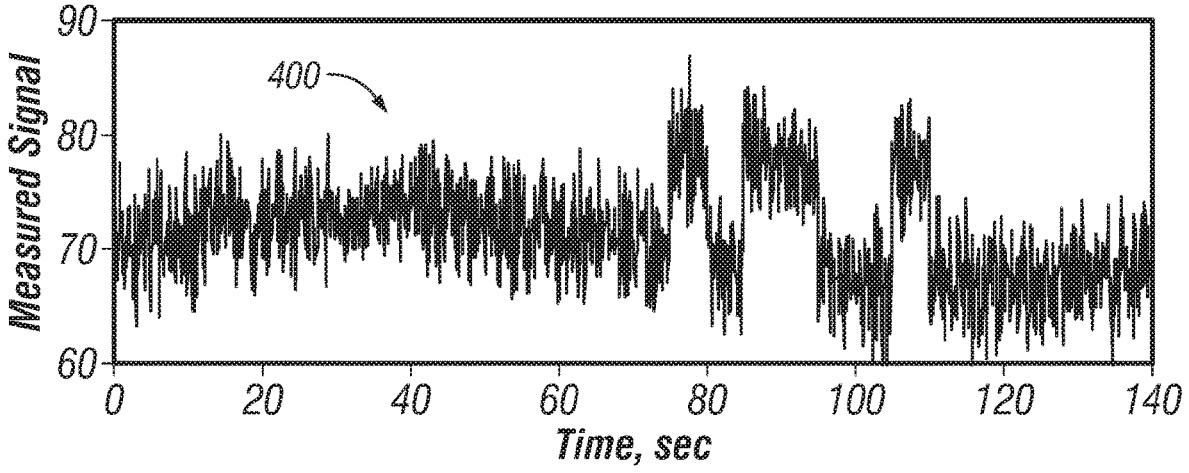
FIG. 4 shows a graph view of a measured signal of the message of FIG. 3, in accordance with one or more embodiments.

FIG. 4 shows a graph view of a measured signal 400 of the message 300 with a receiver, in accordance with one or more embodiments. As shown, the signal 400 is a function of flow rate (e.g., gallons per minute) with respect to time (sec). The signal 400 may be generated using a receiver such as the electrical signal of a turbine generator in fluid communication with the fluid in the tubular string 103 of FIG. 1A. The sinusoidal signal from the generator may be converted to a signal indicative of the flow rate of the fluid. Alternatively, the sinusoidal signal from the generator may be used without a conversion because the output from the generator is correlated with the flow rate of the fluid. Noise has been added to the measured signal 400 to simulate the effects of noise in measuring the flow rate.

Two sources of noise are expected to influence the measured signal: bubble noise and pipeline noise. The bubble noise and pipeline noise can create trade-offs that affect the modulation scheme based on the flow rate amplitude. For example, bubble noise can be overcome by increasing the length of the symbol period. However, as the symbol period approaches the period of the pipeline noise, the signal measured by the receiver becomes more sensitive to the pipeline noise.

Bubble noise is the noise from a multiphase fluid passing through or influencing the receiver. The bubble noise may be modeled as Gaussian noise, which can be reduced by low-pass filtering the measured signal. As a non-limiting example, a $3^{rd}$ order Chebyshev Type I filter may be used as the low-pass filter to reduce the Gaussian noise. A low order Chebyshev filter helps to ensure a stable filter with less chance of rounding errors creating instabilities. The corner frequency for the low-pass filter may be selected to be at least the symbol rate of the modulation scheme. The corner frequency for the low-pass filter may also be designed based on the expressions for $W_{corner}$ and $f_{corner}$. $W_{corner}$ is a ratio between 0 and 1 given by the expression:

$$W_{corner} = \frac{1}{2}\frac{dt}{\tau_{sym}} \tag{1}$$

where $\tau_{sym}$ is the symbol period, and $W_{corner}=1$ corresponds to half the sample rate of the measured signal. The corner frequency, $f_{corner}$, may be calculated with the expression:

$$f_{corner} = \frac{1}{\tau_{sym}} \tag{2}$$

Figure 5:
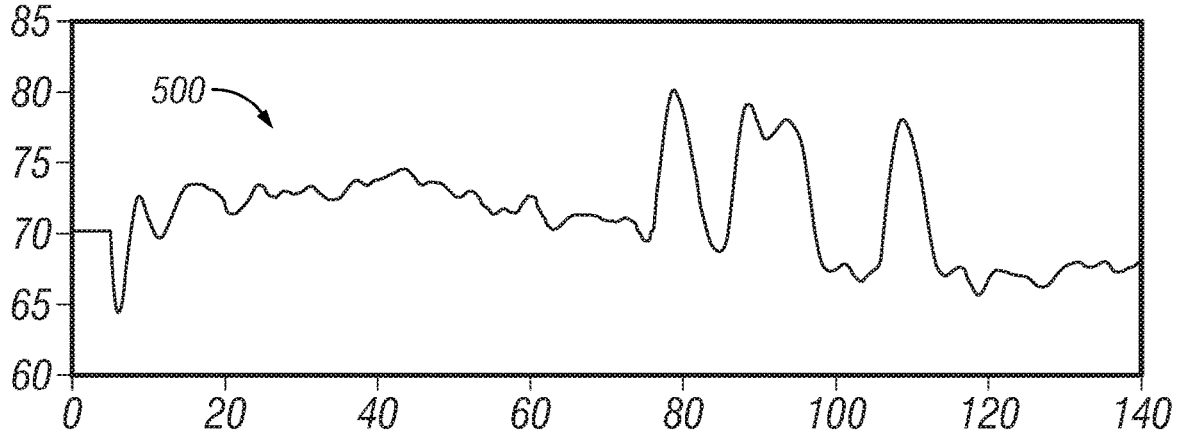
FIG. 5 shows a graph view of the result of filtering the measured signal of FIG. 4 with a low-pass filter, in accordance with one or more embodiments.

FIG. 5 shows a graph view of the result of filtering the measured signal 400 of FIG. 4 with a low-pass filter to reduce the effect of bubble noise, in accordance with one or more embodiments. As shown, the filtered signal 500 is a function of flow rate (e.g., gallons per minute) with respect to time (sec). The filtered signal 500 has essentially averaged out the Guassian noise, but the filtered signal 500 may still be affected by the pipeline noise, which creates difficulties in demodulating the filtered signal 500 based on the amplitude.

The second source of noise may be attributable to the pipeline and/or reservoir. The back pressure in the pipeline can slowly vary over time, and the hydraulic response of the reservoir can also change over time. In modeling, the pipeline and reservoir noise can be simulated as sinusoidal noise, such as sinusoidal noise with a greater period than the symbol period. As used herein, pipeline noise may refer to sinusoidal noise attributable to the hydraulic response of the pipeline or reservoir.

A differential signal is calculated to reduce the influence of pipeline noise on the encoded message. The differential calculation is important to reducing the effect of sinusoidal noise and is given by the expression:

$$s_{diff}(t)=s(t)-s(t-\tau_{sym}) \tag{3}$$

where $s_{diff}(t)$ is the differential signal comprising symbols separated by a symbol period $\tau_{sym}$, s(t) is the signal at a first time, and $s(t-\tau_{sym})$ is the signal at a previous time from the first time separated by the symbol period, $\tau_{sym}$.

Figure 6:
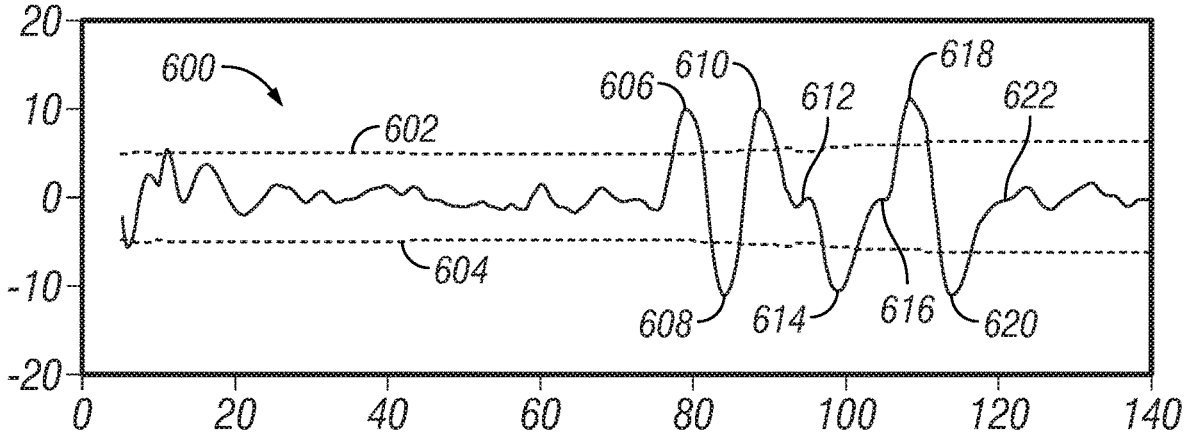
FIG. 6 shows a graph view of a differential signal calculated with the filtered signal of FIG. 5, in accordance with one or more embodiments.

FIG. 6 shows a graph view of a differential signal 600 calculated with the filtered signal 500 using Eq. (3), in accordance with one or more embodiments. As shown, the differential signal 600 is a function of flow rate (e.g., gallons per minute) with respect to time (sec). A positive threshold 602 and a negative threshold 604 are used to decode the symbols 606-622 included in the differential signal 600. The thresholds 602 and 602 may be set as fixed thresholds or dynamic thresholds that are adaptive to the amplitude of the differential signal 600.

A wide variety of amplitude shift-keying schemes can be used to decode the values of the symbols 606-622 in the differential signal 600. For example, if the value of $s_{diff}(t)$ exceeds the positive threshold 602, that symbol is decoded as having a value of "1". If the value of $s_{diff}(t)$ is below the negative threshold 604, the value of that symbol is decoded as "0". If the value of $s_{diff}(t)$ lies within the thresholds 602 and 604, the symbol value is the same as the previous symbol value. For example, the symbol 612 lies within the thresholds 602 and 604, and thus, has a symbol value that is the same as the previous symbol 610, which is "1". Based on this trinary amplitude-shift keying scheme, the symbols 606-622 can be decoded as "101100100", and thus, match the symbols encoded in the message 300 of FIG. 3. However, it should be appreciated that other suitable modulation schemes may be applied to encoding or decoding the message 300. For example, the differential signal 600 provides three amplitude states based on the thresholds 602 and 604. The three amplitude states are where the value of $s_{diff}(t)$ exceeds the positive threshold 602, where the value of $s_{diff}(t)$ is below the negative threshold 604, and where the value of the value of $s_{diff}(t)$ is within the thresholds 602 and 604. Each of the amplitude states may be associated with a different symbol value, e.g., "0", "1", and "11" binary values, and demodulated accordingly.

Figure 7:
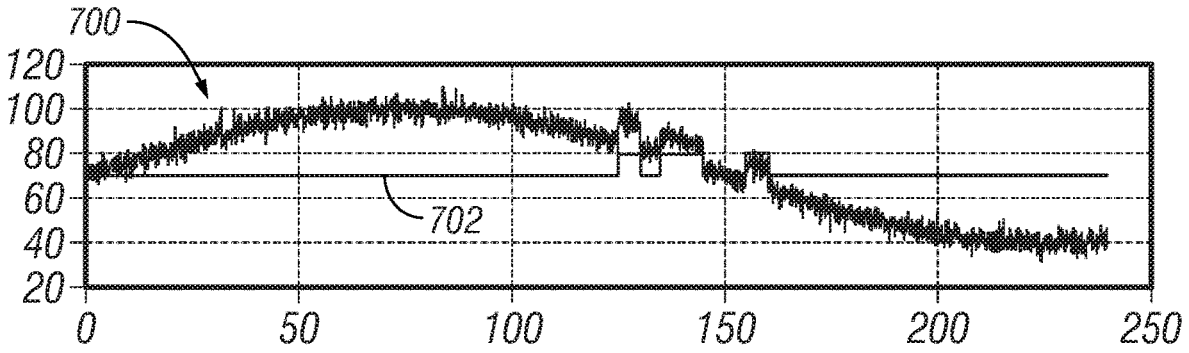
FIG. 7 shows a graph view of a measured signal of the message of FIG. 3 with stronger pipeline noise, in accordance with one or more embodiments.
Figure 8:
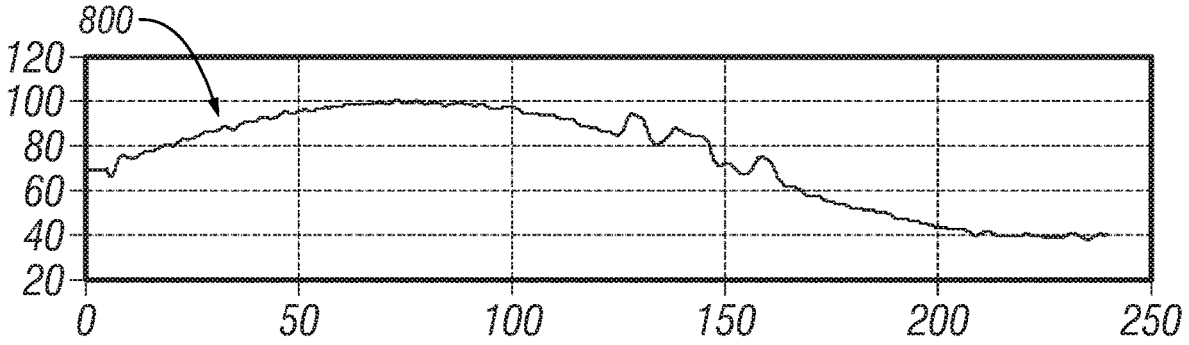
FIG. 8 shows a graph view of the result of filtering the measured signal of FIG. 7 with a low-pass filter, in accordance with one or more embodiments.
Figure 9:
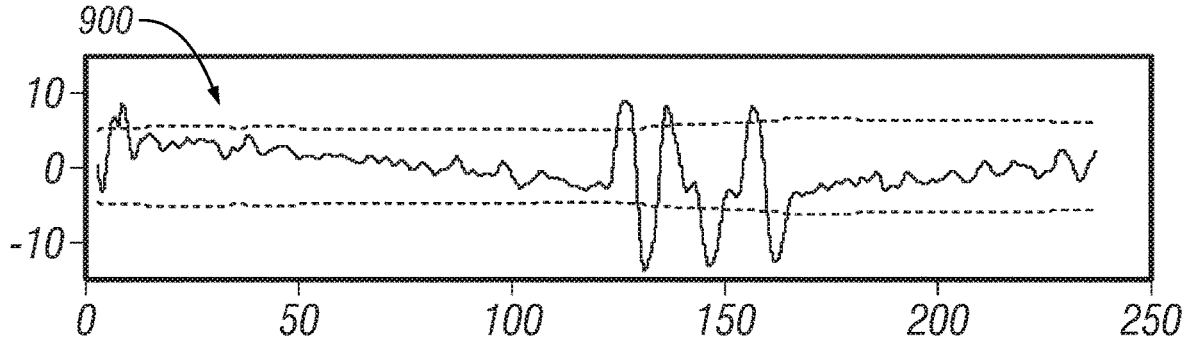
FIG. 9 shows a graph view of a differential signal calculated with the filtered signal of FIG. 8, in accordance with one or more embodiments.

The differential signal can also be used to decode the symbols where the flow rate is greatly influenced by pipeline noise. For example, pipeline noise that greatly influences the symbols may include sinusoidal noise that passes through the low-pass filter and varies in amplitude six times greater than the amplitude shift used to key the symbols. FIGS. 7-9 show graph views of the measured signal 700, the filtered signal 800, and the differential signal 900 in a well system that is greatly influenced by pipeline noise, in accordance with one or more embodiments. As shown in FIGS. 7-9, the signals 700, 800, and 900 are functions of flow rate (e.g., gallons per minute) with respect to time (sec). The pipeline noise is simulated as sinusoidal noise that has a peak-to-peak swing from about 100 gal/min (378 L/min) to about 40 gal/min (151 L/min) with a period of about 300 seconds. The message 702 transmitted using a flow control device is also shown in the graph and includes the same symbols as the message 300 of FIG. 3. As shown in FIG. 8, the bubble noise is reduced by low pass filtering the measured signal 700, but the measured signal 700 is still affected by the pipeline noise. As shown in FIG. 9, the pipeline noise is reduced by calculating the differential signal 900, which is noticeably similar to the differential signal 600 of FIG. 6 despite the stronger pipeline noise present in the measured signal 700. The symbols of the differential signal 900 may be decoded using the same or other suitable demodulation schemes as discussed herein with respect to FIG. 6.

As previously discussed, the modulation and demodulation schemes employed to encode or decode the symbols in the message may take a wide variety of forms. For example, rather than encoding symbols based on two discrete states of the flow rate, the modulation scheme may instead rely on whether the flow rate has changed with respect to the previous symbol encoded. Referring to FIG. 3, if the current symbol value to be encoded matches a selected value, e.g., "1", the flow rate may be varied with respect to the flow rate of the previous symbol encoded or previous state of the flow rate. As a non-limiting example, if the previous symbol had a flow rate of 70 gal/min and the current symbol to be encoded is a "1", the flow rate may be either increased to 80 gal/min or decreased to 60 gal/min to encode the current symbol as a "1". If the symbol value to be encoded matches a another selected value, e.g., "0", the flow rate may maintain the same flow rate as the previous symbol. For example, if the previous symbol had a flow rate of 80 gal/min and the current symbol to be encoded is a "0", the flow rate may maintain the same flow rate as the previous symbol, yielding a flow rate of 80 gal/min. Thus, the symbols encoded in the message 300 may also be "11101011". The absolute value of the differential signal may be used to decode the symbols and is given by the expression:

$$|s_{diff}(t)|=|s(t)-s(t-\tau_{sym})| \tag{4}$$

The resulting absolute value may be compared with one or more positive thresholds to identify the amplitudes that cross or are within the one or more positive thresholds.

Figure 10:
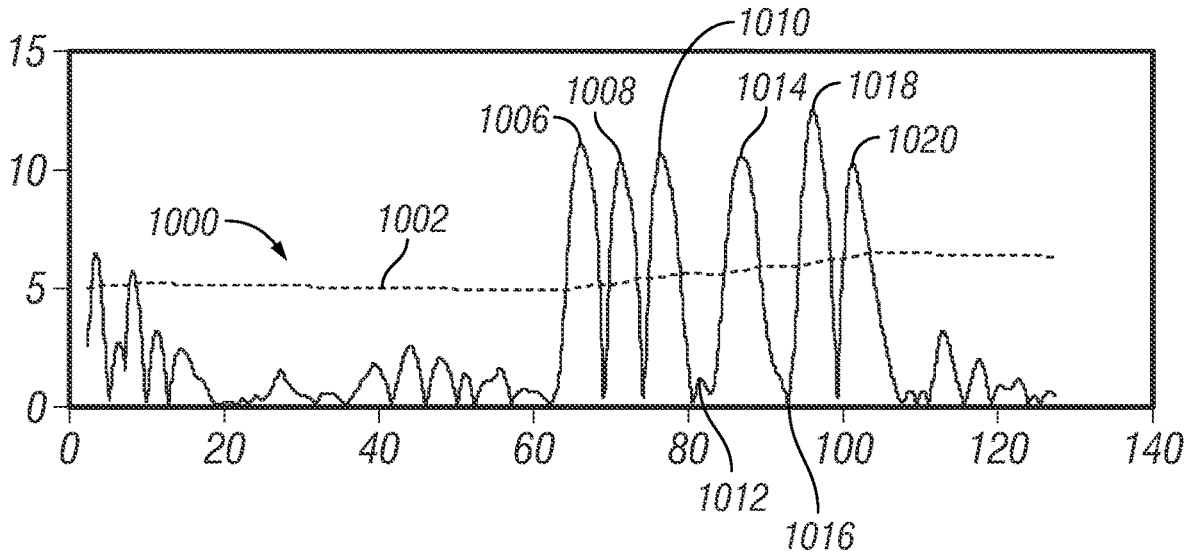
FIG. 10 shows a graph view of the resulting signal of calculating the absolute value of the differential signal of FIG. 6, in accordance with one or more embodiments.

FIG. 10 shows a graph view of the resulting signal 1000 of calculating the absolute value of the differential signal 600, in accordance with one or more embodiments. As shown, the signal 1000 is a function of flow rate (e.g., gallons per minute) with respect time (seconds). A threshold 1002 is used to decode the symbols 1006-1020 included in the differential signal 1000. The threshold may be set as a fixed threshold or a dynamic threshold. As an example decoding operation, if the value of $|s_{diff}(t)|$ exceeds the threshold 1002, the symbol value is decoded as a "1"; and if the value of $|s_{diff}(t)|$ is within the threshold 1002, the symbol value is decoded as a "0". The symbols 1006-1020 are decoded to have the values "11101011", and thus, match the symbols that may also be encoded in the message 300 of FIG. 3. Thus, the absolute value of the differential signal can be used to identify whether the flow rate changes relative to one or more positive thresholds. From this disclosure, it should be appreciated that low-pass filtering and calculating a differential signal can provide a communication system that is reasonably robust to Gaussian-style noise as well as to sinusoidal noise not reduced by low-pass filtering the signal.

Figure 11:
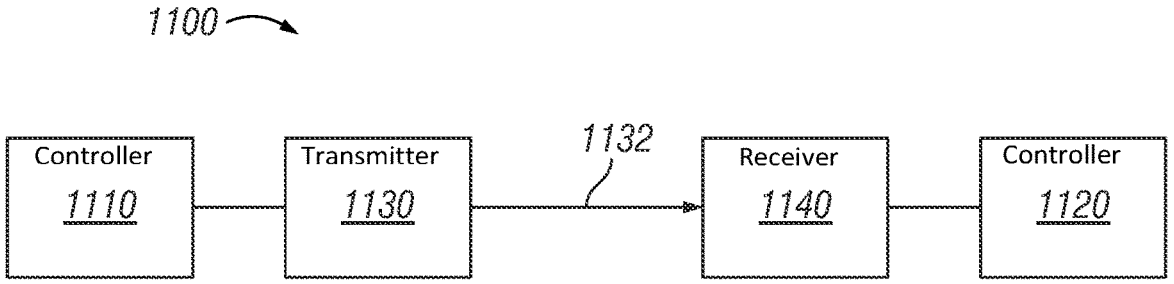
FIG. 11 shows a block diagram of a communication system, according to one or more embodiments.

The communication systems described herein may also apply to communication systems that control the frequency of a signal, e.g., an acoustic signal or an electromagnetic signal. FIG. 11 shows a block diagram of a communication system 1100, according to one or more embodiments. As shown, the communication system 1100 includes controllers 1110 and 1120, a transmitter 1130, and a receiver 1140. The controller 1110 is communicatively coupled to the transmitter 1130 to encode a message using the modulation schemes described herein with respect to FIG. 3. The transmitter 1130 receives the message to be transmitted from the controller and encodes the message by controlling the frequency of a signal 1132 emitted by the transmitter 1130. The transmitter 1130 may include an acoustic transducer or an antenna to emit the signal 1150 as an acoustic signal or electromagnetic signal, respectively.

The receiver 1140 is responsive to the signal 1132 and generates a received signal indicative of the emitted signal. The controller 1120 may convert the received signal to a function of frequency with respect to time. With the received signal represented as a function of frequency with respect to time, the controller 1120 may perform the differential amplitude demodulation schemes described herein with respect to FIGS. 4-10. For example, the signals of FIGS. 4-10 may also be interpreted as functions of frequency with respect to time to demodulate such signals. Additionally, the signals of FIGS. 4-10 may encode the message by controlling the length of the symbol periods using pulse-width modulation, for example a longer symbol period may correspond to a 1-bit and a shorter symbol period may correspond to a 0-bit.

In addition to the embodiments described above, many examples of specific combinations are within the scope of the disclosure, some of which are detailed below:

Example 1

A method of communicating with a device by controlling the flow rate of a fluid, comprising:

transmitting an encoded message with a flow control device by controlling the flow rate of a fluid;

generating a signal indicative of the flow rate with a receiver; and decoding the message by analyzing the signal using amplitude shift-keying.

Example 2

The method of example 1, wherein the signal is a function of the flow rate of the fluid with respect to time.

Example 3

The method of example 1, wherein transmitting further comprises encoding symbols into the message by varying the flow rate of the fluid for a symbol period of a current symbol if the previous symbol value encoded is different from the current symbol value.

Example 4

The method of example 1, wherein transmitting further comprises encoding symbols into the message by varying the flow rate of the fluid for a symbol period of a current symbol if the current symbol value matches a selected value.

Example 5

The method of example 1, wherein decoding the message further comprises calculating a differential signal given by the expression:

$$s_{diff}(t)=s(t)-s(t-\tau_{sym})$$

wherein $s_{diff}(t)$ is the differential signal comprising symbols separated by a symbol period $\tau_{sym}$, s(t) is the signal at a first time, and $s(t-\tau_{sym})$ is the signal at a previous time from the first time separated by the symbol period, $\tau_{sym}$.

Example 6

The method of example 5, wherein decoding the message further comprises calculating the absolute value of the differential signal.

Example 7

The method of example 5, wherein decoding the message further comprises identifying whether a selected symbol of the differential signal crosses a threshold amplitude value to identify a decoded symbol.

Example 8

The method of example 5, wherein decoding the message further comprises if a selected symbol of the differential signal is within a threshold value, identifying a value of a previous symbol with respect to the selected symbol to identify a decoded symbol.

Example 9

The method of example 1, further comprising operating the device based on the decoded message.

Example 10

The method of example 1, wherein the receiver comprises at least one of a flow meter, a turbine generator, an acoustic sensor, and a vibration sensor.

Example 11

The method of example 1, further comprising filtering the signal using a low-pass filter.

Example 12

The method of example 1, further comprising bi-directionally communicating between the device and another device with an additional receiver and an additional flow control device.

Example 13

A system for communicating with a device by controlling the flow rate of a fluid, comprising:

a flow control device in fluid communication with a tubular string and operable to transmit an encoded message by controlling the flow rate of the fluid flowing through the tubular string;

a receiver operable to generate a signal indicative of the flow rate of the fluid in the tubular string; and a controller in communication with the receiver operable to decode the message by analyzing the signal using amplitude shift-keying.

Example 14

The system of example 13, wherein the signal is a function of the flow rate of the fluid with respect to time.

Example 15

The system of example 13, wherein the flow control device is further operable to encode symbols into the message by varying the flow rate of the fluid for a symbol period if the previous symbol value encoded is different from the current symbol value to be encoded.

Example 16

The system of example 13, wherein the controller is further operable to decode the message in part by calculating a differential signal given by the expression:

$$s_{diff}(t)=s(t)=s(t-\tau_{sym})$$

wherein $s_{diff}(t)$ is the differential signal comprising symbols separated by a symbol period $\tau_{sym}$, s(t) is the signal at a first time, and $s(t-\tau_{sym})$ is the signal at a previous time from the first time separated by the symbol period, $\tau_{sym}$.

Example 17

The system of example 13, further comprising the device being operable based on the decoded message.

Example 18

A system for communicating a message to a device, comprising:

a transmitter operable to transmit an encoded message by controlling the frequency of a signal emitted from the transmitter;

a receiver operable to generate a received signal indicative of the emitted signal; and a controller operable to decode the message by analyzing the received signal using amplitude shift-keying.

Example 19

The system of example 18, wherein the received signal is a function of frequency with respect to time.

Example 20

The system of example 18, wherein the controller is further operable to decode the message in part by calculating a differential signal given by the expression:

$$s_{diff}(t)=s(t)-s(t-\tau_{sym})$$

wherein $s_{diff}(t)$ is the differential signal comprising symbols separated by a symbol period $\tau_{sym}$, s(t) is the received signal at a first time, and $s(t-\tau_{sym})$ is the received signal at a previous time from the first time separated by the symbol period, $\tau_{sym}$.

This discussion is directed to various embodiments. The drawing figures are not necessarily to scale. Certain features of the embodiments may be shown exaggerated in scale or in somewhat schematic form and some details of conventional elements may not be shown in the interest of clarity and conciseness. Although one or more of these embodiments may be preferred, the embodiments disclosed should not be interpreted, or otherwise used, as limiting the scope of the disclosure, including the claims. It is to be fully recognized that the different teachings of the embodiments discussed may be employed separately or in any suitable combination to produce desired results. In addition, one skilled in the art will understand that the description has broad application, and the discussion of any embodiment is meant only to be exemplary of that embodiment, and not intended to suggest that the scope of the disclosure, including the claims, is limited to that embodiment.

Certain terms are used throughout the description and claims to refer to particular features or components. As one skilled in the art will appreciate, different persons may refer to the same feature or component by different names. This document does not intend to distinguish between components or features that differ in name but not function, unless specifically stated. In the discussion and in the claims, the terms "including" and "comprising" are used in an open-ended fashion, and thus should be interpreted to mean "including, but not limited to . . . . " Also, the term "couple" or "couples" is intended to mean either an indirect or direct connection. In addition, the terms "axial" and "axially" generally mean along or parallel to a central axis (e.g., central axis of a body or a port), while the terms "radial" and "radially" generally mean perpendicular to the central axis. The use of "top," "bottom," "above," "below," and variations of these terms is made for convenience, but does not require any particular orientation of the components.

Reference throughout this specification to "one embodiment," "an embodiment," or similar language means that a particular feature, structure, or characteristic described in connection with the embodiment may be included in at least one embodiment of the present disclosure. Thus, appearances of the phrases "in one embodiment," "in an embodiment," and similar language throughout this specification may, but do not necessarily, all refer to the same embodiment.

Although the present disclosure has been described with respect to specific details, it is not intended that such details should be regarded as limitations on the scope of the disclosure, except to the extent that they are included in the accompanying claims.

What is claimed is:

1. A method of communicating with a downhole tool in a borehole, comprising:

controlling a flow rate of a fluid flowing uphole through the borehole to encode a message using amplitude shift-keying and transmitting the encoded message in the fluid flowing against a direction of flow to the downhole tool using a flow control device at Earth's surface;

generating a signal indicative of the encoded message with a receiver locatable downhole; and decoding the encoded message downhole by analyzing the signal using the amplitude shift-keying.

2. The method of claim 1, wherein the signal is a function of the flow rate of the fluid with respect to time.

3. The method of claim 1, wherein said transmitting further comprises encoding symbols into the encoded message by varying the flow rate of the fluid for a symbol period of a current symbol if the current symbol is different from a previous symbol.

4. The method of claim 1, wherein said transmitting further comprises encoding symbols into the encoded message by varying the flow rate of the fluid for a symbol period of a current symbol if a value of the current symbol matches a selected value.

5. The method of claim 1, wherein said decoding the encoded message further comprises calculating a differential signal given by an expression: s diff(t)=s(t)−s(t−rsym); wherein s diff (t) is the differential signal comprising symbols separated by a symbol period rsym, s(t) is the signal at a first time, and s(t−rsym) is the signal at a previous time from the first time separated by the symbol period, rsym.

6. The method of claim 5, wherein said decoding the encoded message further comprises calculating an absolute value of the differential signal.

7. The method of claim 5, wherein said decoding the encoded message further comprises identifying whether a selected symbol of the differential signal crosses a threshold amplitude value to identify a decoded symbol.

8. The method of claim 5, wherein said decoding the encoded message further comprises if a selected symbol of the differential signal is within a threshold value, identifying a value of a previous symbol with respect to the selected symbol to identify a decoded symbol.

9. The method of claim 1, further comprising operating the downhole tool based on said decoding the encoded message.

10. The method of claim 1, wherein the receiver comprises at least one of a flow meter or a turbine generator.

11. The method of claim 1, wherein the fluid is a multiphase fluid and further comprising filtering the signal using a low-pass filter to remove bubble noise caused by the fluid flowing from a formation.

12. The method of claim 1, further comprising bi-directionally communicating between the downhole tool and another device with an additional receiver and an additional flow control device.

13. The method of claim 1, further comprising operating the receiver to provide power to the downhole tool.

14. A system for communicating with a downhole tool in a borehole, comprising:

a flow control device locatable at Earth's surface and in fluid communication with a tubular string, the flow control device being operable to control a flow rate of a fluid flowing uphole through the tubular string to encode a message using amplitude shift-keying and transmit the encoded message in the fluid flowing against a direction of flow to the downhole tool;

a receiver locatable downhole in the borehole and operable to generate a signal indicative of the encoded message; and a controller locatable downhole in the borehole in communication with the receiver and operable to decode the encoded message by analyzing the signal using the amplitude shift-keying.

15. The system of claim 14, wherein the signal is a function of the flow rate of the fluid with respect to time.

16. The system of claim 14, wherein the flow control device is further operable to encode symbols into the encoded message by varying the flow rate of the fluid for a symbol period of a current symbol if the current symbol is different from a previous symbol.

17. The system of claim 14, wherein the controller is further operable to decode the encoded message in part by calculating a differential signal given by an expression: s diff(t)=s(t)−s(t−rsym); wherein s diff(t) is the differential signal comprising symbols separated by a symbol period rsym, s(t) is the signal at a first time, and s(t−rsym) is the signal at a previous time from the first time separated by the symbol period, rsym.

18. The system of claim 14, further comprising the downhole tool being operable downhole based to decode the encoded message.

19. The system of claim 14, wherein the receiver is operable to provide power to the downhole tool.

20. A system for communicating a message to a downhole tool locatable downhole in a borehole, comprising:

a transmitter locatable at Earth's surface and operable to control a frequency of a signal emitted from the transmitter by controlling a flow rate of a fluid flowing uphole through the borehole to encode the message using frequency shift-keying and transmit the encoded message in the fluid flowing against a direction of flow to the downhole tool;

a receiver locatable downhole in the borehole and operable to generate the signal indicative of the encoded message; and a controller locatable downhole in the borehole and operable to decode the encoded message by analyzing the signal using the frequency shift-keying.

21. The system of claim 20, wherein the system wherein the controller is further operable to decode the encoded message in part by calculating a differential signal given by an expression:

$$s\ \mathrm{diff}(t)=s(t)-s(t-\mathrm{rsym});$$

wherein s diff(t) is the differential signal comprising symbols separated by a symbol period rsym, s(t) is the signal at a first time, and s(t−rsym).

22. The system of claim 20, wherein the signal is a function of the frequency with respect to time.

23. The system of claim 20, wherein the receiver is operable to provide power to the downhole tool.

* * * * *